US009670616B2

(12) United States Patent
Raines et al.

(10) Patent No.: US 9,670,616 B2
(45) Date of Patent: Jun. 6, 2017

(54) ACTIVE WEB SPREADING AND STABILIZATION SHOWER

(71) Applicant: Georgia-Pacific Consumer Products LP, Atlanta, GA (US)

(72) Inventors: David Drew Raines, Stone Mountain, GA (US); Kenneth C. Henderson, Baton Rouge, LA (US); Anthony C. Jelks, Norwood, LA (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

(21) Appl. No.: 14/948,721

(22) Filed: Nov. 23, 2015

(65) Prior Publication Data

US 2016/0168792 A1 Jun. 16, 2016

Related U.S. Application Data

(60) Provisional application No. 62/090,684, filed on Dec. 11, 2014.

(51) Int. Cl.

| | |
|---|---|
| ***D21F 7/00*** | (2006.01) |
| ***D21F 5/00*** | (2006.01) |
| ***D21G 1/02*** | (2006.01) |
| ***B65H 23/24*** | (2006.01) |
| ***D21F 5/18*** | (2006.01) |

(Continued)

(52) U.S. Cl.

CPC ..... *D21F 7/00* (2013.01); *B65H 23/022* (2013.01); *D21F 5/187* (2013.01); *D21G 1/00* (2013.01); *B65H 2406/122* (2013.01); *B65H 2515/842* (2013.01); *B65H 2801/84* (2013.01)

(58) Field of Classification Search

CPC ..... D21F 7/00; D21F 1/34; D21F 5/00; D21F 5/187; D21F 5/188; B65H 23/24; B65H 2406/112; B65H 2406/111; B65H 2406/122; B65H 2515/842; B65H 2801/84; B05B 13/0278; B05B 13/041;

(Continued)

(56) References Cited

U.S. PATENT DOCUMENTS 2,689,515 A 9/1954 Andrews, Jr.
3,096,233 A * 7/1963 Rappaport ..... D21F 7/04 162/193

(Continued)

FOREIGN PATENT DOCUMENTS

CA 1243197 A 10/1988
CA 2098946 C * 4/1996 ..... D21F 5/042

(Continued)

*Primary Examiner* — Jose Fortuna
(74) *Attorney, Agent, or Firm* — Laura L. Bozek

(57) ABSTRACT

Described herein are methods and systems for reducing, preventing, or eliminating wrinkles in a paper sheet during papermaking. The systems may include a dryer configured to dry a continuous paper sheet having a travel direction. The system may also include at least one roll configured to receive the dried continuous paper sheet. The systems may also include an air spreader located downstream of the dryer and upstream of the at least one roll. The at least one roll may include one or more calendering rolls. The air spreader may include a plurality of nozzles configured to expel a gas toward the dried sheet. The nozzles may be oriented in a direction at least partially opposed to the travel direction of the dried sheet.

12 Claims, 4 Drawing Sheets

(51) Int. Cl.
*D21G 1/00* (2006.01)
*B65H 23/022* (2006.01)

(58) Field of Classification Search
CPC ..... B05B 15/0431; D21H 23/50; D21G 1/00; D21G 1/02
See application file for complete search history.

(56) References Cited

U.S. PATENT DOCUMENTS

| | | | | |
|---|---|---|---|---|
| 3,220,723 | A | 11/1965 | Rainbow | |
| 3,593,990 | A | 7/1971 | Plumat et al. | |
| 4,271,601 | A | 6/1981 | Koponen et al. | |
| 4,274,210 | A * | 6/1981 | Stengard | B65H 23/24 226/196.1 |
| 4,321,107 | A | 3/1982 | Page | |
| 4,472,888 | A * | 9/1984 | Spiller | B41F 23/0426 226/196.1 |
| 5,331,749 | A | 7/1994 | Thiele | |
| 5,379,526 | A * | 1/1995 | Haverinen | D21F 5/042 34/114 |
| 5,411,251 | A | 5/1995 | Schmid et al. | |
| 5,438,765 | A * | 8/1995 | Tyrmi | D21G 9/0063 34/115 |
| 5,471,766 | A | 12/1995 | Heikkila et al. | |
| 5,522,151 | A * | 6/1996 | Deshpande | D21F 5/042 34/114 |
| 5,553,397 | A | 9/1996 | Schwitzky et al. | |
| 5,634,636 | A | 6/1997 | Jackson et al. | |
| 5,687,964 | A | 11/1997 | Stephan et al. | |
| 5,720,852 | A * | 2/1998 | Virta | D21G 9/0063 162/193 |
| 5,752,641 | A * | 5/1998 | Klas | B41F 23/0423 226/97.3 |
| 5,829,166 | A * | 11/1998 | Klas | B65H 23/24 226/97.3 |
| 5,915,304 | A | 6/1999 | Stiel | |
| 5,951,006 | A | 9/1999 | Biegelsen et al. | |
| 6,004,430 | A | 12/1999 | Ilvespaa et al. | |
| 6,004,432 | A | 12/1999 | Page et al. | |
| 6,032,923 | A | 3/2000 | Biegelsen et al. | |
| 6,094,560 | A | 7/2000 | Thomas | |
| 6,131,308 | A | 10/2000 | Kramer et al. | |
| 6,279,898 | B1 | 8/2001 | Stephan | |
| 6,282,812 | B1 | 9/2001 | Wee et al. | |
| 6,361,041 | B2 | 3/2002 | Stephan | |
| 6,442,369 | B1 | 8/2002 | Swartz et al. | |
| 6,442,864 | B2 | 9/2002 | Ringer et al. | |
| 6,454,903 | B2 * | 9/2002 | Mohrsen | D21G 9/0063 162/193 |
| 6,527,268 | B2 | 3/2003 | Spurk | |
| 6,543,662 | B1 | 4/2003 | Kuhlmann et al. | |
| 6,543,765 | B2 | 4/2003 | Kerpe et al. | |
| 6,585,259 | B2 | 7/2003 | Kerpe et al. | |
| 6,585,263 | B1 | 7/2003 | Bredenberg et al. | |
| 6,740,200 | B2 | 5/2004 | Seymour et al. | |
| 7,073,274 | B2 | 7/2006 | Yoshida | |
| 7,311,234 | B2 | 12/2007 | Solberg | |
| 7,377,999 | B2 | 5/2008 | Ahvenniemi et al. | |
| 7,448,147 | B2 | 11/2008 | Parent et al. | |
| 7,459,062 | B2 | 12/2008 | Mayer et al. | |
| 8,083,895 | B2 | 12/2011 | Alev et al. | |
| 8,092,143 | B2 | 1/2012 | Yang et al. | |
| 8,177,940 | B2 | 5/2012 | Kramer et al. | |
| 9,297,119 | B2 * | 3/2016 | Raines | D21H 25/08 |
| 2001/0013280 | A1 * | 8/2001 | Mohrsen | D21G 9/0063 100/76 |
| 2001/0035509 | A1 | 11/2001 | Chase et al. | |
| 2002/0069990 | A1 | 6/2002 | Augscheller et al. | |
| 2004/0011492 | A1 | 1/2004 | Grabscheid et al. | |
| 2005/0279476 | A1 | 12/2005 | Ahvenniemi et al. | |
| 2006/0133085 | A1 | 6/2006 | Bendner et al. | |
| 2007/0090188 | A1 | 4/2007 | Li et al. | |
| 2009/0134565 | A1 | 5/2009 | Duan | |
| 2009/0242156 | A1 * | 10/2009 | Loippo | D21G 9/0063 162/202 |
| 2013/0068593 | A1 | 3/2013 | Galkin | |
| 2015/0240419 | A1 * | 8/2015 | Sekiya et al. | D21H 23/50 239/296 |
| 2016/0168792 | A1 * | 6/2016 | Raines | D21F 7/00 162/118 |

FOREIGN PATENT DOCUMENTS

| | | | | |
|---|---|---|---|---|
| CA | 2095461 | C * | 3/1997 | D21F 5/042 |
| DE | 3942029 | A1 * | 7/1990 | B65H 23/24 |
| EP | 2889429 | A1 * | 7/2015 | D21H 23/50 |
| GB | 1 600 518 | A | 10/1981 | |
| KR | 20150046198 | A * | 4/2015 | D21H 23/50 |
| WO | WO 2004/015197 | A1 | 2/2004 | |
| WO | WO 2012/067570 | A1 | 5/2012 | |
| WO | WO 2012/067573 | A1 | 5/2012 | |
| WO | WO 2012/119034 | A2 | 9/2012 | |
| WO | WO 2016094087 | A1 * | 6/2016 | D21F 7/00 |

* cited by examiner

ACTIVE WEB SPREADING AND STABILIZATION SHOWER

CROSS-REFERENCE TO RELATED APPLICATION

This application is based on U.S. Provisional Patent Application No. 62/090,684, filed Dec. 11, 2014, which is incorporated herein by reference in its entirety.

BACKGROUND

The present disclosure relates to paper manufacturing and processing. The present disclosure also relates to methods and systems for reducing, eliminating, or preventing folding or wrinkling prior to, or as part of, winding or calendering processes.

During paper manufacturing and processing, a paper web or sheet can pass through one or more calendering rolls to control the thickness, bulk, and/or surface properties of the web. In some instances, calendering can involve passing a continuous web between a pair of continuously-turning rollers having a pattern or texture that is imparted to the web as the web passes between the calendering rollers. In other instances, calendering can involve passing a continuous web between a pair of continuously-turning rollers to impart smoothness or uniformity to the surface of the web as the web passes between the calendering rollers.

The web can also be wound onto a large roll or reel one or more times during the process. The winding process involves continuously and repeatedly turning a large roll about a central shaft, drawing the paper sheet onto the roll as the sheet leaves another component of the paper machine. For example, the winding process may occur as the web exits a drying section of the paper machine or as the web exits the calendering rollers. The web may also be rewound following a first winding section in one or more subsequent roll-to-roll winding sections.

Paper manufacturing and processing typically involves moving the paper product at very high speeds. Because of these high speeds, defects may occur in the web. For example, the paper product may experience wrinkles, folds, curling, edge flutter, and the like. Certain paper processing operations, such as calendering and winding, increase the likelihood of these defects. For example, as the web passes from a dryer to the calendering rollers, folds and wrinkles form as the web is transported to the calendering rollers. These folds and wrinkles can be compressed by the calendering rollers, creating folds, wrinkles, or other defects in the web and also defects in the calendered pattern imparted by the rollers. These folds, wrinkles, and pattern defects are types of "visual defects" that are seen in the final paper web.

Various methods have been employed in order to control a paper web to avoid such defects. For example, mechanical spreading has been used, which requires a web to be dragged over bowed elements. However, such dragging action typically has negative effects on sheet properties. Such prior methods are not ideal, typically having negative effects on sheet properties, and are not as effective at higher speeds. They also do not sufficiently reduce folding and wrinkling in the calendering and winding processes, resulting in visual defects in the final product.

Accordingly, a need exists for an improved method of reducing, preventing, or eliminating defects in the papermaking process that does not suffer from the problems discussed above. The present disclosure provides advantages over prior mechanical spreading means by applying air to directly spread the web via an air spreader, such as without dragging the web over various elements. The application of a foil on the opposite side of the web may also provide additional advantages to support the web as the gas is expelled against it. The air spreader described herein also provides certain advantages to decrease or reduce wrinkles and folds in the web as it proceeds to, for example, calendering rollers, embossing rollers, or winding rollers, which prevents visual defects, such as wrinkles, folds, or pattern defects in the final web.

SUMMARY OF THE DISCLOSURE

In accordance with certain aspects and embodiments of the present disclosure, various methods, devices, and systems are described for reducing, preventing, or eliminating defects in a paper web or sheet, such as visual defects including wrinkles or folds, during or prior to calendering or winding. The terms "web" and "sheet" are used interchangeably herein, unless otherwise indicated.

According to an aspect of this disclosure, a system for reducing wrinkles in a paper sheet during papermaking may include a dryer configured to dry a continuous paper sheet. The system may also include at least one roll configured to receive the dried continuous paper sheet. The system may also include an air spreader located downstream of the dryer and upstream of the roll. The air spreader may include a plurality of nozzles configured to expel a gas toward the dried sheet. The nozzles may be oriented in a direction at least partially opposed to the travel direction of the dried sheet.

According to one aspect, the dryer may be a Yankee dryer. According to another aspect, the dryer may be a through-air-dryer. According to another aspect, the at least one roll may include a calendering roll or a pair of calendering rolls. According to another aspect, the at least one roll may be a winding roll or rewinding roll. According to another aspect, the at least one roll may include a calendering roll followed by one or more winding rolls.

According to a further aspect, the system may include a positioning component configured to change the position of the air spreader. The positioning component may be configured to move the position of the air spreader between a resting position and a working position. The working position may be closer to the sheet than the resting position. The system may also include a control unit configured to pressurize the air spreader when the air spreader is in the working position, and to depressurize the air spreader when the air spreader is in the resting position.

According to still a further aspect, the air spreader may be configured to expel the gas toward the sheet at a direction and a velocity sufficient to reduce wrinkles in the sheet. The air spreader may be configured to expel the gas toward the sheet at a direction and a velocity sufficient to increase tension within the sheet.

According to another aspect, each nozzle in the plurality of nozzles may be configured to expel a cone-shaped stream of gas toward the sheet.

According to yet another aspect, each nozzle in the plurality of nozzles may include a metal tube extending from a base portion of the air spreader.

According to a further aspect, the system may include a dust collector configured to collect dust removed from the dried sheet by the air spreader.

The method may also include providing a foil along a portion of a first side of the dried paper web. The method may include expelling a gas toward a second side of the dried paper web, opposite the first side, via an air spreader. The air spreader may include a plurality of nozzles oriented in a direction at least partially opposed to the travel direction of the dried paper web. The method may include subsequently contacting the dried paper web with at least one roll.

According to one aspect, the at least one roll may be a calendering roll. The calendering roll may be downstream of the air spreader.

According to another aspect, the at least one roll may be a winding roll. The winding may be downstream of the air spreader. The winding roll may also be downstream of a calendering roll.

According to a further aspect, the method may include positioning the air spreader using a moveable positioning component. The method may include rotating the air spreader between a resting position and a working position. The working position may be closer to the dried paper web than the resting position.

According to another aspect, expelling gas toward the dried paper web may include expelling the gas at a direction and velocity sufficient to reduce wrinkles in the dried paper web. Expelling the gas toward the dried paper web may include expelling the gas at a direction and velocity sufficient to increase tension within the dried paper web.

According to still another aspect, each nozzle in the plurality of nozzles may include a metal tube extending from a base portion of the air spreader. Each nozzle in the plurality of nozzles may expel a cone-shaped stream of gas.

According to yet a further aspect, the method may include pressurizing the air spreader when the air spreader is in the working position, and depressurizing the air spreader when the air spreader is in the resting position. The system may further include a control unit configured to pressurize the air spreader when the air spreader is in the working position, and to depressurize the air spreader when the air spreader is in the resting position.

According to another aspect, a system for stabilizing a web may include a web that has a travel direction. The web may have a first side and a second side. The system may include a foil disposed along a portion of the first side of the web. The system may include an air spreader located in proximity to the second side of the web. The air spreader may include a plurality of nozzles configured to expel a gas toward the second side of the web in a direction at least partially opposed to the travel direction.

According to another aspect, the system may include a dryer located upstream of the air spreader and configured to dry of the web. The dryer may be a Yankee dryer.

According to a further aspect, the system may include at least one roll downstream of the air spreader. The at least one roll may include at least one calendering roll. The at least one roll may include at least one winding roll.

According to another aspect, the air spreader may be attached to a positioning component configured to change a position of the air spreader. The positioning component may be rotatable such that the air spreader can be moved between a resting position and a working position. The working position may be closer to the web than the resting position.

According to another aspect, the air spreader may be configured to expel the gas toward the second side of the web at a direction and a velocity sufficient to reduce wrinkles from the web.

According to a further aspect, the air spreader may be configured to expel the gas toward the second side of the web at a direction and a velocity sufficient to increase tension within the web.

According to yet another aspect, each nozzle in the plurality of nozzles may include a metal tube extending from a base portion of the air spreader. Each nozzle in the plurality of nozzles may be configured to expel a cone-shaped stream of gas.

Additional advantages of the described methods, devices, and systems will be set forth in part in the description which follows, and in part will be obvious from the description, or may be learned by practice of the disclosure. The advantages of the disclosure will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments and together with the description, serve to explain the principles of the disclosure.

DESCRIPTION

Reference will now be made in detail to certain exemplary embodiments, examples of which are illustrated in the accompanying drawings. Where possible, the same reference numbers will be used throughout the drawings to refer to the same or like items.

Figure 1:
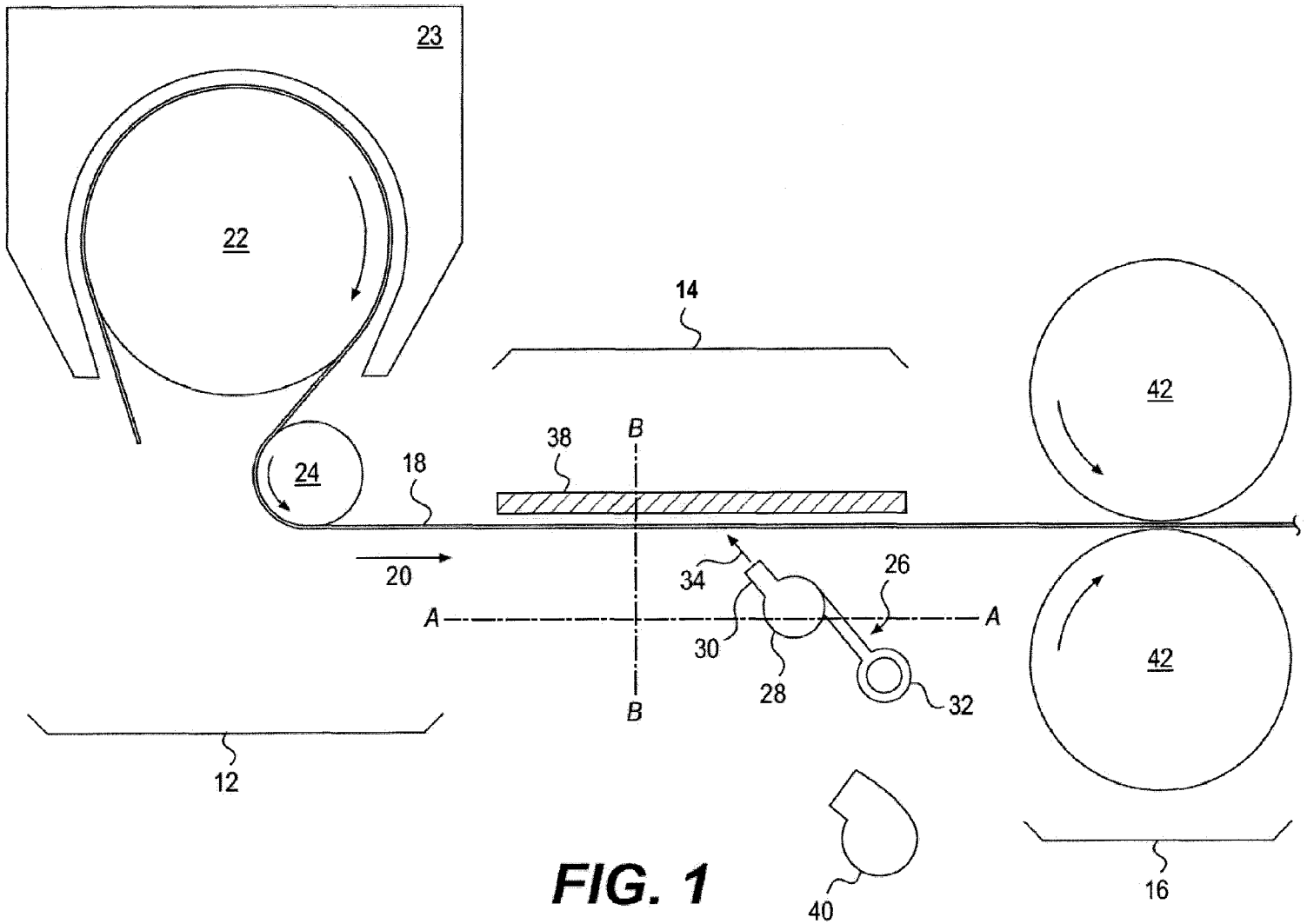
FIG. 1 shows a side view of an exemplary papermaking system.

FIG. 1 depicts an exemplary embodiment of an exemplary papermaking system. The exemplary papermaking system depicts only a part of the overall process of making and processing paper, and may include other steps, processes, machinery, or devices that are not shown in FIG. 1. FIG. 1 includes a drying section 12, a web spreading section 14, and a calendering section 16. It is understood that drying section 12, web spreading section 14, and calendering section 16 are exemplary only and that these sections may include other components and processes not shown in FIG. 1.

As shown in FIG. 1, a web 18 passes through drying section 12, web spreading section 14, and calendering section 16 in a travel direction 20. Web 18 may be a non-woven web, such as, for example, a paper web, non-woven polymer web, melt-blown web, or melt-spun web.

Drying section 12 receives web 18 in a moist or wet state, and dries web 18 using a dryer. As generally described herein, web 18 is in a relatively drier state as it passes from drying section 12 to web spreading section 14 as compared to when web 18 entered drying section 12. The degree of drying performed in drying section 12 may vary depending on the design of the papermaking system. For example, the web may exit drying section 12 at a moisture content of less than or equal to about 30%, less than or equal to about 25%, less than or equal to about 20%, less than or equal to about 15%, less than or equal to about 10%, or less than or equal to about 5%, such as in a range from about 0% to about 25%, from about 5% to about 20%, or from about 5% to about 15%.

As shown in FIG. 1, the dryer of drying section 12 may be a Yankee dryer, such as known in the art. The elements of the Yankee dryer are only partially shown in FIG. 1, and it is understood that drying section 12 may include other components not shown in FIG. 1. The dryer may include a dryer roll 22 that may be enclosed by a dryer hood or dryer shroud 23. Dryer roll 22 facilitates travel of web 18 through the dryer hood 23 where web 18 is dried, such as by the application of heat. Drying section 12 may also include a pressure roll 24 that maintains tension in web 18 as it passes through drying section 12 and into web spreading section 14. According to some embodiments, drying section 12 may include a blade (not shown), such as, for example, a doctoring or creping blade, to facilitate removal of web 18 from dryer roll 22 as it passes to pressure roll 24.

Web spreading section 14 includes an air spreader 26. Air spreader 26 expels a gas towards web 18 as web 18 passes from drying section 12 to calendering section 16. Air spreader 26 may also be referred to as a "web spreader," and prevents, removes, or smoothes wrinkles and folds in web 18 through the application of expelled gas. According to some embodiments, air spreader 26 may be positioned downstream of drying section 12, such as, for example, downstream of pressure roll 24 or downstream of a creping blade (not shown) that facilitates removal of web 18 from dryer roll 22. According to some embodiments, web spreader 26 may be positioned upstream of a calendering section, embossing section, calendering roll, or embossing roll. According to some embodiments, web spreader 26 may be positioned upstream of a winding roll or rewinding roll. Air spreader 26 may include a base portion 28 and a plurality of nozzles 30. Nozzles 30 may project from or extend from base portion 28. For example, nozzles 30 may include a tube extending or projecting from base portion 28 through which the gas is expelled.

According to some embodiments, base portion 28 may provide a conduit for the gas to pass to the plurality of nozzles 30, through which the gas is expelled towards web 18. For example, the gas expelled from air spreader 26 may come from a gas supply or gas source (not shown) that is operatively coupled to base portion 28. The gas supply may include, for example, a compressed gas supply, such as, for example, a compressed air tank. The gas from the gas supply or gas source may pass through a tube or hollow portion of base portion 28 to supply the gas to nozzles 30. The gas may then pass to nozzles 30 where it is expelled towards web 18. The gas supply or gas source may include a compressor to increase the pressure of the gas expelled from nozzles 30. The compressor may include a variable speed compressor to adjust the pressure at which gas is supplied and expelled from air spreader 26. The gas supply or gas source may be operatively connected to base portion 28 through hoses or piping generally known in the art.

According to some embodiments, nozzles 30 direct the gas towards web 18 to facilitate spreading of the web. According to some embodiments, nozzles 30 are positioned such that they expel the gas in a direction 34 that is at least partially opposed to travel direction 20 of web 18, as shown, for example, in FIG. 1. Direction 34 may be, for example, a direction that is directed towards an edge of web 18, but also directed against travel direction 20.

According to some embodiments, direction 34 may be, for example, in a direction that is directed towards an edge of web 18, but also directed with travel direction 20.

Figure 2A:
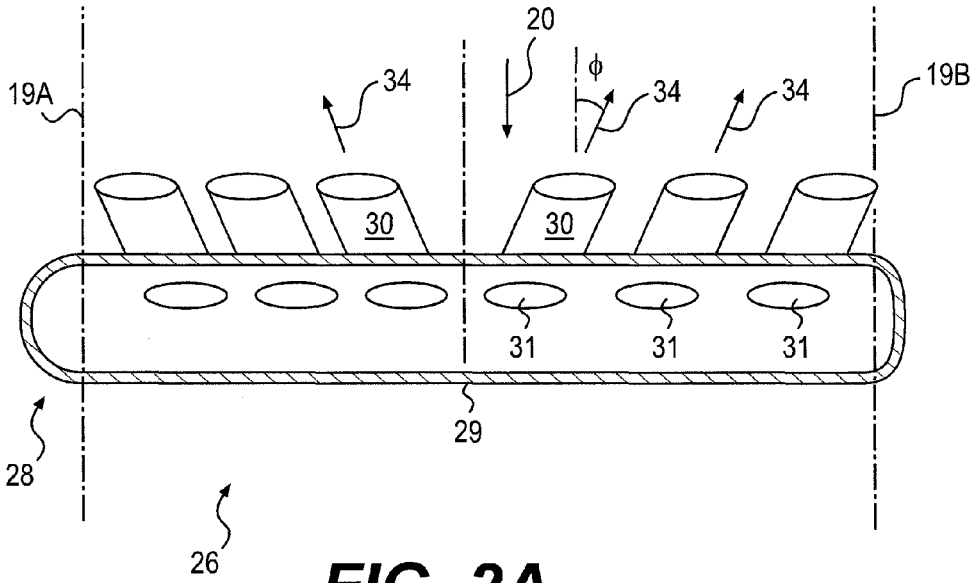
FIG. 2A shows cross-section of a portion of an exemplary air spreader taken about plane A-A of FIG. 1.

FIG. 2A shows a cross-section of a portion of exemplary air spreader 26, including a base portion 28 and nozzles 30. For example, FIG. 2A shows a cross-section of base portion 28, as viewed through plane A-A of FIG. 1. FIG. 2A also shows travel direction 20 and gas expulsion direction 34. Although the manufacture of air spreader 26 may take many forms, in some embodiments, such as shown in FIG. 2A, base portion 28 may include a hollow tubular component 29, such as a metallic or plastic tube forming at least part of base portion 28. The expelled gas may be received via an inlet of tubular component 29, such as inlet 33 of FIG. 2B. Nozzles 30 may be attached to the exterior of tubular component 29 of base portion 28 and holes 31 in tubular component 29 allow the gas to flow from the interior of base portion 28 through nozzles 30, where the gas is expelled towards web 18. The shape and direction of nozzles 30 determines the direction of the expelled gas.

Although FIG. 2A shows a single tubular component 29, base portion 28 may include more than one tubular component with each tubular component being connected to one or more nozzles 30. For example, base portion 28 may include two tubular components with each tubular component expelling gas toward a different edge of web 18. According to some embodiments, base portion 28 may include a plurality of tubular components positioned in series in travel direction 20.

FIG. 2A shows tubular component 29 having a generally circular cross section, but it is contemplated that tubular component 29 may have any shape of cross section, such as, for example, an elliptical, square, or rectangular cross section.

As can be seen in FIG. 2A, direction 34 of the gas expelled from nozzles 30 may be directed against travel direction 20, but offset by an angle $\phi$ towards edges 19A and 19B (shown in dashed lines in FIG. 2A) of web 18. Angle $\phi$, which represents direction 34 projected into plane of web 18 (which is parallel to plane A-A of FIG. 1), between travel direction 20 and direction 34 may be greater than 0 degrees (i.e., when direction 34 is directly opposite travel direction 20 in the plane of web 18), but less than 90 degrees (i.e., when direction 34 is perpendicular to travel direction 20 in the plane of web 18). As shown in FIG. 2A, nozzles 30 expel a gas at an angle $\phi$ that is partially opposed to travel direction 20. Angle $\phi$ may be, for example, between 5 degrees and 80 degrees, such as between 10 degrees and 75 degrees, between 30 degrees and 60 degrees, between 10 degrees and 30 degrees, between 30 degrees and 45 degrees, between 45 degrees and 60 degrees, or between 60 degrees and 75 degrees. The different nozzles 30 may each have the same or different angle $\phi$.

Figure 3A:
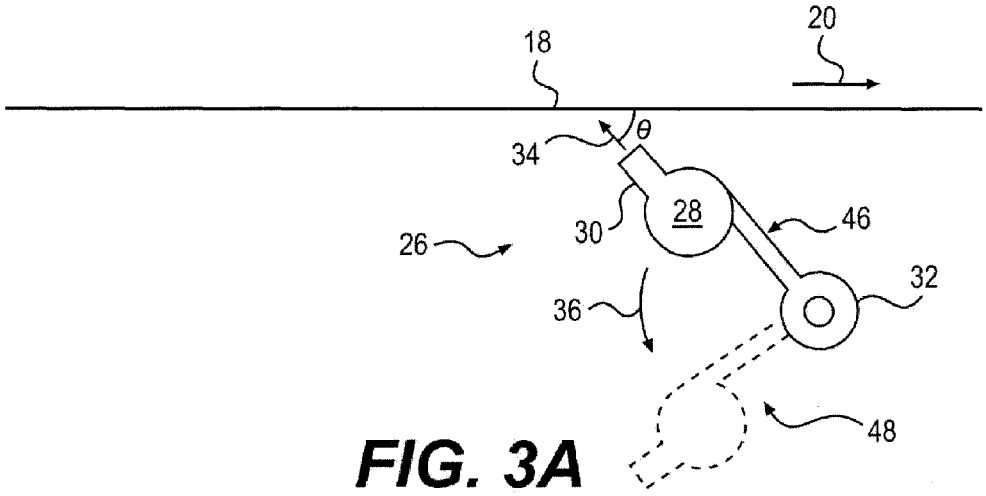
FIG. 3A shows a portion of an exemplary papermaking system and exemplary movement of an air spreader.

Angle $\phi$ is measured by projecting direction 34 into the plane of web 18; however, it is understood the direction 34 will also be angled into web 18 itself, such as by an angle $\theta$ (as shown in FIG. 3A) projected into the plane of FIG. 3A (which is the same as the plane of FIG. 1 in the drawings). For example, as shown in FIG. 3A, angle $\theta$ may be greater than 0 degrees (i.e., when direction 34 is directly opposed to travel direction 20 of web 18 when projected into the plane of FIG. 3A), but less than 90 degrees (i.e., when direction 34 is perpendicular to travel direction 20 when projected into the plane of FIG. 3A). Angle $\theta$ may be, for example, between 15 degrees and 90 degrees, such as between 30 degrees and 60 degrees or between 40 degrees and 50 degrees, between 45 degrees and 60 degrees, or between 60 degrees and 90 degrees. Without being bound by a particular theory, it is believed that varying angle θ may alter the amount of sheet drag experienced by web 18 as it passes air spreader 26.

The different nozzles 30 may each have the same or different angle θ. Angle θ is determined when air spreader 26 is in a working position 46, such as described in this disclosure.

According to some embodiments, angles ϕ and θ may be, for example, in a range from 90 degrees and 180 degrees (such direction 34 in the same direction as travel direction 20), such as between 120 degrees and 150 degrees or between 130 degrees and 140 degrees, between 135 degrees and 150 degrees, or between 150 degrees and 180 degrees. For example, when angle ϕ is greater than 90 degrees, direction 34, when projected into the plane of web 18 is toward an edge of web 18 but also partially in the direction of travel direction 20. When angle θ is greater than 90 degrees, nozzles 30 projected into the plane of FIG. 3A are at least partially directed into web 18 in the direction of travel direction 20.

According to some embodiments, some nozzles in the plurality of nozzles 30 may be partially opposed to travel direction 20 and some nozzles in the plurality of nozzles 30 may be partially in the direction of travel direction 20.

Together angles ϕ and θ describe the angular components of direction 34 in a three-dimensional papermaking system.

Figure 2B:
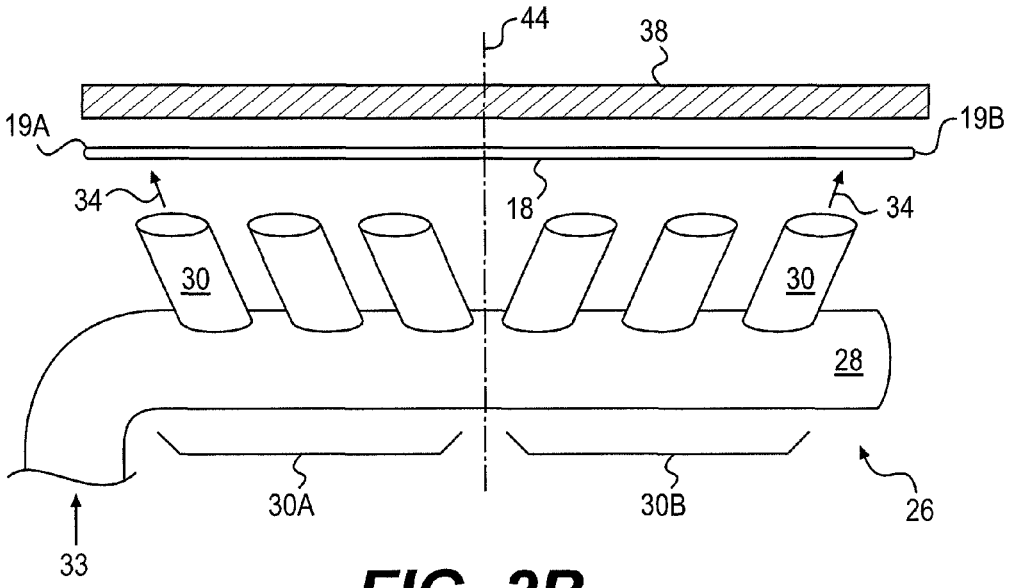
FIG. 2B shows a portion of an exemplary air spreader taken about plane B-B of FIG. 1.

FIG. 2B shows a portion of exemplary air spreader 26 viewed from plane B-B of FIG. 1 together with web 18 and foil 38, with travel direction 20 of web 18 being into the plane of FIG. 2B. As shown in FIG. 2B, nozzles 30 may be directed in two nozzle groups 30A and 30B toward respective edges 19A and 19B of web 18. For example, nozzle group 30A, as shown in FIG. 2B, expels gas in a direction 34 towards edge 19A of web 18. Similarly, nozzle group 30B expels a gas in a direction 34 towards edge 19B of web 18. Each of nozzle groups 30A and 30B may be directed away from a center line 44, which corresponds to the center of web 18, such as, for example, at an angle ϕ, but towards different edges of web 18.

As also shown in FIG. 2B, nozzles 30 may extend towards the edge of sheet 18 such that the gas expelled in directions 34 is expelled towards edges 19A and 19B of web 18 along the width of web 18. According to some embodiments, however, nozzles 30 may extend past edges 19A and 19B of web 18, such that the expelled gas from nozzles 30 at the edge of base portion 28 do not expel a gas that contacts web 18, but the nozzles 30 that are closer to the center of base portion 28 do expel a gas the contacts and spreads web 18.

According to other embodiments, nozzles 30 may be placed in such a way that they do not reach the edges 19A and 19B of web 18. For example, nozzles 30 may expel a gas in directions 34, but nozzles 30 are positioned at a spacing less than the entire width of web 18.

According to some embodiments, the pressure exerted from nozzles 30 across the length of air spreader 26 may be relatively uniform. It is contemplated, however, that the pressure from different nozzles 30 may be varied, such as through different sized or shaped nozzles, through the use of more than one tubular component 29, through variations in base portion 28, or through the use of a controller. Varying the pressure at different positions of air spreader 26 may further improve the performance of air spreader 26.

As also shown in FIG. 2B, nozzles 30 may be placed relatively close to web 18. For example, when in the working position 46, the nozzles 30 may be positioned in a range from about 0.25 inches and about 5 inches from web 18, such as from about 0.5 inches to about 5 inches, from about 1 inch to about 4 inches, from about 1 inch to about 3 inches, from about 1 inch to about 2 inches, from about 2 inches to about 4 inches, from about 2 inches to about 3 inches, from about 3 inches to about 4 inches, from about 3 inches to about 4 inches, from about 4 inches to about 5 inches, or from about 0.5 inches to about 2 inches from web 18. Nozzles 30 expel the gas towards a first face or side of web 18 while a second face or side of web 18 faces foil 38. Foil 38 acts to support web 18 as the gas from air spreader 26 blows against it. Foil 38 may prevent web 18 from developing holes or wrinkles as a result of the pressure from the expelled gas.

By expelling a gas towards web 18, such as in direction 34, air spreader 26 may prevent or remove wrinkles or folds in web 18 by spreading web 18. For example, as the expelled gas presses against web 18 in direction 34, it may smooth, reduce, or prevent folds or wrinkles in the web by spreading web 18 towards an exterior edge of web 18. For example, the direction 34 and velocity of the gas may smooth wrinkles and folds in web 18, thereby preventing visual defects such as folds and wrinkles in web 18 as it passes through calendering section 16. According to some embodiments, air spreader 26 may prevent or remove wrinkles or folds by pushing them to the edge of web 18. According to some embodiments, air spreader 26 may also increase tension in web 18. For example, the velocity and direction 34 of the expelled gas may increase the tension by spreading web 18 towards an exterior edge (19A and 19B of FIG. 2B). By increasing the tension and/or preventing wrinkles in web 18, air spreader 26 may also incrementally increase the width of web 18.

Air spreader 26 may be attached to the papermaking system through various means. For example, air spreader 26 may be attached to a frame or support structure (not shown) of the papermaking system. Air spreader 26 may also constitute a separate component that is coupled or attached to existing processing equipment. For example, air spreader 26 may, in some embodiments, be bolted, clamped, or otherwise fastened to structural elements of a paper making apparatus. It is therefore contemplated that air spreader 26 may be removable from other parts of the papermaking system, which may facilitate maintenance or replacement of air spreader 26.

Air spreader 26 may also act to remove dust and other particles from web 18 through the application of the expelled gas. For example, since direction 34 is at least partially opposed to travel direction 20, the expelled gas may lift particles or dust from web 18. This may further increase the visual appeal of a final product because the dust and particles will not become embedded in the web as it passes through subsequent calendering or winding sections.

According to some embodiments, air spreader 26 may optionally be movable to facilitate maintenance of air spreader 26 and to adjust the operation of air spreader 26. For example, as shown in FIG. 3A, air spreader 26 may include a moveable portion 32 that allows air spreader 26 to be moved such that the air spreader 26 is then farther away from web 18. When air spreader 26 is positioned such that the nozzles 30 are directed towards web 18, this position may be referred to as a working position 46. When air spreader 26 is moved away from web 18, this may be referred to as a resting position 48. An exemplary resting position 48, such as shown in FIG. 3A may be such that nozzles 30 are not directed towards web 18. For example, FIG. 1 and FIG. 3A show air spreader 26 in a working position 46. In some embodiments, movable portion 32 may rotate air spreader 26 in a direction 36 to a resting position 48. The exemplary resting position 48 in FIG. 3A is shown by dotted lines representing air spreader 26 after it has been rotated away from web 18.

A resting position may serve one or more of several purposes. For example, it may facilitate cleaning of air spreader 26, such as nozzles 30 and base portion 28. It may also facilitate maintenance of the machinery in air spreader 26, such as a compressor or compressed gas supply (not shown), gas supply hoses (not shown), or structural equipment (not shown). The resting position may further facilitate cleaning and maintenance of the other components of the papermaking system. The resting position may also facilitate cleaning of air spreader 26, while allowing continuous processing of web 18. For example, by moving air spreader 26 away from web 18, technicians or maintenance personnel can service air spreader 26 while allowing web 18 to continue being processed by the papermaking system.

Figure 3B:
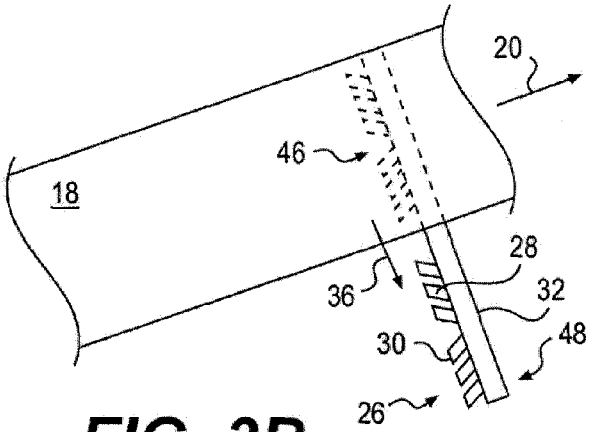
FIG. 3B shows a portion of an exemplary papermaking system and exemplary movement of an air spreader.

Although FIG. 3A shows movable portion 32 as rotating air spreader 26 from a working position 46 to a resting position 48, it is understood that air spreader 26 may be moved between working position 46 and resting position 48 by other means. For example, movable portion 32 may include a slidable frame that moves air spreader 26 away from web 18. For example, the slidable frame may allow air spreader 26 to slide into or out of the plane of FIG. 1 or perpendicular to the travel direction 20, as shown in FIG. 3B. FIG. 3B depicts a view of portions of web spreading section 14 from a plane parallel to plane A-A of FIG. 1, but viewed from a side of web 18 opposite air spreader 26. FIG. 3B shows air spreader 26 being moved from a working position 46 (dashed lines beneath web 18) to a resting position 48 in direction 36 away from web 18, shown in solid lines. This movement is facilitated by movable portion 32 on which air spreader 26 may slide or roll. In this way, air spreader 26 may be moved clear of web 18 to facilitate maintenance and cleaning of air spreader 26.

Figure 3C:
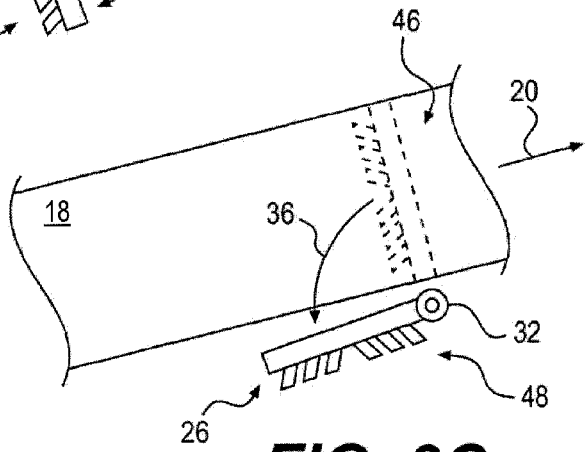
FIG. 3C shows a portion of an exemplary papermaking system and exemplary movement of an air spreader.

In other embodiments, a slidable frame may move web spreader 26 vertically or diagonally away from web 18, such as, for example, in the plane of FIG. 1, but away from web 18. According to some embodiments, movable portion 32 may operate to swing air spreader 26 clear of web 18, such as, for example, by rotating air spreader 26 about an axis perpendicular to the plane of web 18, as shown in FIG. 3C. As shown in FIGS. 3B and 3C, resting position 48 (solid lines) may lie away from web 18. It is contemplated that the exemplary movable elements may also be used in combination with each other. For example, air spreader 26 may be moved vertically or horizontally on a slidable frame and then rotated about rotatable portion.

As shown in FIG. 1, web spreading section 14 may optionally include a foil 38. Foil 38 may be positioned relatively close to web 18. When the gas is expelled from air spreader 26 towards web 18, web 18 may flex or bow as the gas is applied. Foil 38 supports web 18, thereby preventing web 18 from breaking, developing holes, or tearing.

Although FIG. 1 shows only one exemplary foil 38, it is understood that other foils or supports (not shown) may be used to support or retain web 18 throughout web spreading section 14. For example, one or more foils, bars, or rollers may be placed above or below web 18 to support web 18 as it passes from drying section 12 through web spreading section 14 to calendering section 16. Additional rollers (not shown) may also affect the path of web 18 to maintain or adjust the tension of web 18 as it travels through web spreading section 14.

According to some embodiments, web spreading section 14 may optionally include a collector 40. Collector 40 may trap or collect dust or other particles that are removed from web 18 by air spreader 26. Collector 40 may include a negative pressure source, such as a vacuum, to attract the dust and particles to collector 40.

After passing through web spreading section 14, web 18 may pass to calendering section 16. According to some embodiments, calendering section 16 may include one or more calendering rollers 42. Calendering rollers 42 may be smooth surfaced or apply a pattern, embossment, or texture to web 18 by applying pressure to web 18 to impart a texture or pattern to the web. According to some embodiments, calendering rollers 42 may include embossing rollers that impart a textured pattern to web 18 through a raised pattern on the embossing rollers that alters the surface of web 18, as known in the art. Because calendering rollers 42 and embossing rollers apply a visual pattern or texture to web 18, when web 18 enters the rollers with folds or wrinkles, the applied pressure can press the fold or wrinkle into the pattern creating a visual defect. Similarly, if the fold or wrinkle is later removed or smoothed out, the visual pattern from calendering or embossing will be broken or deformed where the fold or wrinkle was present. By preventing or smoothing folds and wrinkles, air spreader 26 prevents these visual defects by providing a smoother web 18 as the web enters calendering section 16.

According to some embodiments, calendering section 16 may include one or more winding rollers (not shown) after or in place of calendering rollers 42. A winding roller collects web 18 by continuously rotating to wrap web 18 around a winding roll for subsequent storage or transport. Similar to calendering rollers 42, air spreader 26 may prevent visual defects from being introduced into a rolled web by using an air spreader prior to a winding roll to smooth the wrinkles and folds as web 18 passes to the winding roller.

Figure 4A:
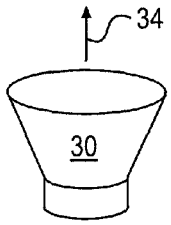
FIGS. 4A-4H show exemplary nozzles that may be used with an exemplary air spreader.
Figure 4B:
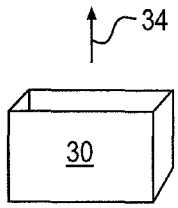
Figure 4C:
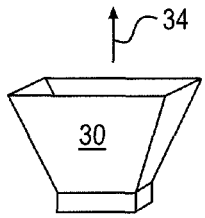
Figure 4D:
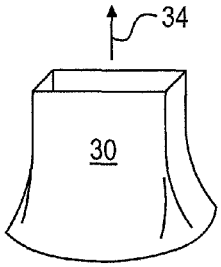
Figure 4E:
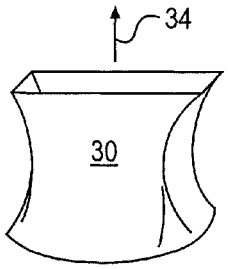
Figure 4F:
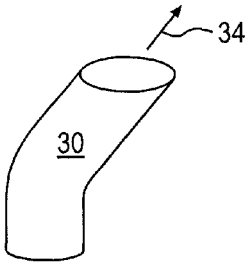
Figure 4G:
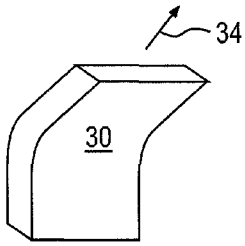
Figure 4H:
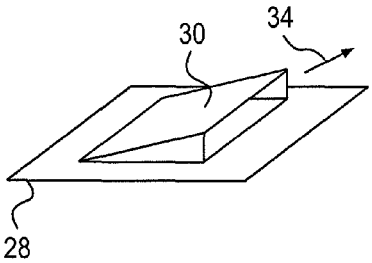

Although FIGS. 1, 2A, and 2B show generally straight, circular cross-sectioned nozzles, it is understood that these are exemplary only and that other nozzle shapes could be used. FIGS. 4A-4H show other exemplary configurations for nozzles 30. For example, FIG. 4A shows a conical nozzle that expels a cone of air towards web 18. FIG. 4B shows an elongated rectangular nozzle. FIG. 4C shows a tapered nozzle having a rectangular opening through which the gas is expelled, but a tapered or triangular shape. FIG. 4D shows a nozzle having a circular base, but a rectangular opening through which the gas is expelled. FIG. 4E shows a nozzle having a circular base and a rectangular opening, through which the gas is expelled, but a generally tapered shape. FIG. 4F shows a tubular nozzle having a generally circular cross-section, but a bent portion to direct the gas in direction 34. FIG. 4G shows a bent tube similar to FIG. 4F, but having a generally rectangular cross-section. FIG. 4H shows a nozzle having a projected housing from base portion 28 to expel a gas in direction 34. It is also contemplated that various combinations of the nozzles shown in FIGS. 4A-4H may also be used. For example, the nozzles shown in FIGS. 4F and 4G may have tapered or conical shapes, as shown in FIGS. 4A and 4C, respectively. Other combinations of nozzle shapes are also contemplated. However, other nozzle shapes may be used as part of the air spreader, and would be known to those of skill in the art. Direction 34 and angles $\phi$ and θ are measured with respect to the central axis of nozzle 30, as shown in FIGS. 4A-4H.

Base portion 28 may also have a variety of cross-sectional shapes. Although FIGS. 1, 2A, 2B, and 3A depict a roughly circular tube for base portion 28, it is contemplated that square, rectangular, or elliptical cross-sections may also be used. However, the use of a regular geometric cross-section, such as a circular, square, or rectangular cross-section, for base portion 28 may facilitate easier manufacture of air spreader 26.

The components of air spreader 26 may be made from any suitable materials appropriate for the environment in which it is used. For example, base portion 28 and nozzles 30 may be made from aluminum, stainless steel, copper, or other metals or alloys. They may also be made from plastic or composite materials, such as, for example, PVC, ABS, or polymer composites. It is also contemplated that the components of air spreader 26 may be made from different materials. For example, base portion 28 and nozzles 30 may be made from metallic materials or plastics, but a hose or tube supplying the gas to air spreader 26 may be made from, for example, steel flex hose, plastic tubing, or rubber tubing. Other combinations or materials are also contemplated and any suitable combination may be used.

Although FIG. 1 shows a single air spreader 26, it is contemplated that more than one air spreader 26 may be present. For example, two or more air spreaders may be placed sequentially along travel direction 20 in web spreading section 14. According to some embodiments, more than one air spreader 26 may be placed in parallel across the width of web 18. For example, nozzle group 30A may include a first air spreader and nozzle group 30B may include a second air spreader. According to some embodiments, one or more air spreaders 26 may be placed in web spreading section 14, prior to, for example, calendering rollers 42, and one or more additional air spreaders 26 may be placed along travel direction 20 after calendering rollers 42 and prior to, for example, a winding roll (not shown). Other combinations of two or more air spreaders is also possible.

It is contemplated that any number of nozzles 30 may be used to facilitate spreading of web 18. Different nozzles in air spreader 26 may have different shapes.

It is also contemplated that air spreader 26 may have more than one row of nozzles 30, such as, for example, two or more rows of nozzles 30. When more than one row of nozzles 30 is present, the rows may include the same number of nozzles 30 or may include different numbers of nozzles 30.

According to some embodiments, the papermaking system or web spreading section 14 may include a control unit (not shown) to control the operation of air spreader 26. For example, the control unit may include a computer processor and/or memory having instructions or software programmed to control the operation of air spreader 26.

According to some embodiments, the control unit may operate to control the movement of air spreader 26, for example, from a working position 46 to a resting position 48. For example, at a break in web 18, or when the papermaking system is not in operation, the control unit may move air spreader 26 from a working position 46 to a resting position 48. This may facilitate maintenance or cleaning of both web spreader 26 and the papermaking system. The control unit may also be configured to control the flow of the gas expelled from air spreader 26. For example, when air spreader 26 is in a working position 46, the control unit may control an air compressor or pump to pressurize the air spreader such that the gas is expelled from nozzles 30 towards web 18. When air spreader 26 is in a resting position 48, the control unit may depressurize air spreader 26, such that the gas is not expelled from nozzles 30.

According to some embodiments, the control unit may also operate to pressurize or depressurize air spreader 26 depending on whether web 18 is present and the papermaking system is operation. For example, if web 18 is not present, the control unit may depressurize air spreader 26 until web 18 begins to pass through web spreading section 14, at which time, the control unit pressurizes air spreader 26.

It should be noted that the methods and systems described herein should not be limited to the examples provided. Rather, the examples are only representative in nature.

In addition, other embodiments will be apparent from consideration of the specification and practice of the present disclosure. It is intended that the specification and examples be considered as exemplary only, with a true scope and spirit of the invention being indicated by the following claims.

What is claimed is:

1. A system for reducing wrinkles in a paper sheet during papermaking, comprising:

a dryer in the system configured to dry a continuous paper sheet having a travel direction;

at least one roll in the system configured to receive the dried continuous paper sheet; and an air spreader located in a web spreading section of the system downstream of the dryer and upstream of the at least one roll, the air spreader comprising a plurality of nozzles configured to expel a gas toward the dried sheet, wherein the nozzles are oriented in a direction at least partially opposed to the travel direction of the dried sheet.

2. The system of claim 1, further comprising a positioning component operatively coupled to the air spreader, the positioning component configured to change a position of the air spreader.

3. The system of claim 2, wherein the positioning component is further configured to move the position of the air spreader between a resting position and a working position, the working position being closer to the sheet than the resting position.

4. The system of claim 3, further comprising a control unit configured to pressurize the air spreader when the air spreader is in the working position, and to depressurize the air spreader when the air spreader is in the resting position.

5. The system of claim 1, wherein the air spreader is configured to expel the gas toward the sheet at a direction and a velocity sufficient to reduce wrinkles in the sheet.

6. The system of claim 1, wherein the air spreader is configured to expel the gas toward the sheet at a direction and a velocity sufficient to increase tension within the sheet.

7. The system of claim 1, wherein each nozzle in the plurality of nozzles comprises a metal tube extending from a base portion of the air spreader and oriented in the direction at least partially opposed to the travel direction of the dried sheet.

8. The system of claim 1, wherein each nozzle in the plurality of nozzles is configured to expel a cone-shaped stream of gas toward the sheet.

9. The system of claim 1, further comprising a dust collector positioned in the web spreading section of the system, the dust collector configured to collect dust removed from the dried sheet by the air spreader.

10. The system of claim 1, wherein the at least one roll is a calendering roll.

11. The system of claim 1, wherein the at least one roll is a winding roll.

12. The system of claim 1, wherein the at least one roll is a calendering roll followed by a winding roll.

* * * * *